US008051846B2

(12) United States Patent
Sugishita

(10) Patent No.: US 8,051,846 B2
(45) Date of Patent: Nov. 8, 2011

(54) TWO-CYCLE ENGINE

(75) Inventor: Yuu Sugishita, Kawagoe (JP)

(73) Assignee: Husqvarna Zenoah Co., Ltd., Kawagoe-Shi, Saitama (JP)

( * ) Notice: Subject to any disclaimer, the term of this patent is extended or adjusted under 35 U.S.C. 154(b) by 570 days.

(21) Appl. No.: 12/245,827

(22) Filed: Oct. 6, 2008

(65) Prior Publication Data

US 2009/0095268 A1 Apr. 16, 2009

(30) Foreign Application Priority Data

Aug. 13, 2007 (JP) ..... 2007-210765

(51) Int. Cl.
*F02M 23/00* (2006.01)

(52) U.S. Cl. ... 123/590; 123/593; 123/549; 123/184.22; 123/184.23

(58) Field of Classification Search ..... 123/590, 123/593, 549, 3, 25 C, 184.22, 184.23
See application file for complete search history.

(56) References Cited

U.S. PATENT DOCUMENTS

| | | | | |
|---|---|---|---|---|
| 3,687,122 | A * | 8/1972 | Kamo | 123/550 |
| 3,965,873 | A | 6/1976 | Konomi et al. | |
| 4,020,812 | A * | 5/1977 | Hayward | 123/549 |
| 4,074,661 | A * | 2/1978 | Noguchi et al. | 123/3 |
| 4,116,183 | A * | 9/1978 | Hayward | 123/549 |
| 4,281,626 | A * | 8/1981 | Fishe | 123/25 C |
| 4,711,225 | A | 12/1987 | Holderle et al. | |
| 4,773,382 | A * | 9/1988 | Smith et al. | 123/661 |
| 5,005,533 | A * | 4/1991 | Suzuki et al. | 123/184.22 |
| 6,640,787 | B2 * | 11/2003 | Hashimoto et al. | 123/499 |

FOREIGN PATENT DOCUMENTS

| | | |
|---|---|---|
| JP | 50-025923 A | 3/1975 |
| JP | 51-075819 A | 6/1976 |
| JP | 61-032564 U | 2/1986 |
| JP | 62-206263 A | 9/1987 |

OTHER PUBLICATIONS

Japanese Office Action dated Sep. 13, 2011 (and English translation thereof) in counterpart Japanese Application No. 2007-210765.

* cited by examiner

*Primary Examiner* — Michael Cuff
*Assistant Examiner* — Long T Tran
(74) *Attorney, Agent, or Firm* — Holtz, Holtz, Goodman & Chick, P.C.

(57) ABSTRACT

Through holes formed on an atomization pipe can prevent fuel adhering on inner walls of the through holes from escaping. In addition, when fuel adhering on an inner circumferential surface of the atomization pipe flows toward a downstream side, the fuel enters the through holes. Thus, the fuel can be confined therein. Furthermore, an absorbing member can absorb the fuel that has adhered to a downstream inner wall of the atomization pipe and flows toward the downstream side. Moreover, a periphery of the intake passage hole of a gasket protrudes from the inner wall, so that flow of the fuel that the absorbing member fails to absorb toward the downstream side can be blocked. Accordingly, a rapid increase in the amount of fuel flowing into the engine body can be reliably prevented. Therefore, fluctuation in the number of revolutions of the engine can be sufficiently restrained.

4 Claims, 6 Drawing Sheets

TWO-CYCLE ENGINE

BACKGROUND OF THE INVENTION

1. Field of the Invention

The present invention is related to a two-cycle engine.

2. Description of Related Art

Conventionally, a two-cycle engine including an engine body, a carburetor, and an inlet pipe that connects the engine body and the carburetor is known. Being simple in mechanism and light in weight, such a two-cycle engine is often installed in a portable work machine such as a chain saw.

In the engine, a fuel ingredient in a mixture gas adheres on an inner wall of an inlet pipe. When negative pressure in the inlet pipe is elevated, this fuel (fuel ingredient) is suctioned into the engine body. Such a suction causes an excessive fuel delivery to flow into the engine body until fuel is delivered again in a standard amount, lowering the number of revolutions and thus making the engine unstable. Such an excessive suction of fuel by the engine may occur periodically, Besides, when a posture of a portable work machine in which the engine is installed changes, fuel (mixture gas) staying in the inlet pipe flows into the engine body, which is another cause of the fluctuation of the number of revolutions.

In view of the above, fluctuation of the revolutions have conventionally been restrained by increasing the revolving inertia of the engine with a flywheel or the like. However, in recent years, an engine without a flywheel or the like is occasionally employed for weight reduction. Because the revolving inertia of such an engine is small, the fluctuation of the revolutions cannot be restrained by the revolving inertia.

To solve the problem, an engine in which a large number of projections shaped in tetrangular pyramids are provided on the inner wall of the inlet pipe is known (e.g., Document 1: JP-A-62-206263). In the engine of Document 1, the projections can restrain the fuel adhering on the inner wall of the inlet pipe from flowing toward the engine body, so that the fluctuation of the number of revolutions can be restrained.

However, with the engine of Document 1, flow of the fuel (mixture gas) staying in the inlet pipe into the engine body due to change in posture of the portable work machine in which the engine is installed cannot be sufficiently prevented In addition, when the negative pressure in the inlet pipe is elevated, the fuel adhering on the inner wall of the inlet pipe inevitably flows into the engine though the flow amount may be small. Therefore, improvement can be made to the engine of Document 1 with in terms of restraining fluctuation of the number of revolutions.

SUMMARY OF THE INVENTION

An object of the invention is to provide a two-cycle engine that can sufficiently restrain fluctuation of the number of revolutions.

A two cycle-engine according to an aspect of the invention includes: a carburetor, an engine body; and an inlet pipe in which an inlet pipe intake passage that communicates the carburetor and the engine body is formed, in which the inlet pipe includes an inlet pipe body in which the inlet pipe intake passage is formed, an atomization pipe fitted with the inlet pipe intake passage, an absorbing ring fitted with the inlet pipe intake passage, and a gasket interposed between the engine body and the inlet pipe body, the atomization pipe is shaped in a bottomless basket and having a plurality of through holes formed on an outer circumferential wall thereof, the absorbing ring includes a ring-shaped ring body and an absorbing member provided to an outer circumference of the ring body and abutting to an inner wall of the inlet pipe intake passage, and the gasket is provided with an intake passage hole whose opening area is smaller than an opening area of the inlet pipe intake passage.

According to the aspect of the invention, the through holes formed on the atomization pipe can prevent the fuel adhering on inner walls of the through holes (i.e., an inner wall of the inlet pipe passage) from escaping. In addition, when the fuel adhering on an inner circumferential surface of the atomization pipe flows toward a downstream side (a side adjacent to the engine body), the fuel enters the through holes. Thus, the fuel can be confined therein. Furthermore, the absorbing member can absorb the fuel that has adhered on the downstream inner wall of the atomization pipe and flows toward the downstream side. Moreover, in the gasket, a periphery of the intake passage hole smaller than the inlet pipe intake passage protrudes from the inner wall of the inlet pipe intake passage, so that the periphery blocks flow of the fuel that the absorbing member fails to absorb toward the downstream side. Also, when a posture of the work machine in which the engine according to the aspect of the invention is changed, the periphery prevents the fuel (mixture gas) staying in the inlet pipe intake passage from rapidly flowing, into the engine body.

Accordingly, with the aspect of the invention, such atomization pipe, absorbing member, and gasket can reliably prevent a rapid increase in the amount of fuel flowing into the engine body. Therefore, fluctuation in the number of revolutions of the engine can be sufficiently refrained. Because the number of revolutions of an engine can be sufficiently restrained since when a machine is new, an operator can enjoy a favorable feeling as if already being used to the machine since when the machine is new. Additionally, because fluctuation in the number of revolutions of the engine can be sufficiently restrained, the engine is prevented from being halted when the engine is rapidly overloaded (prevention of engine stall).

In addition, because the atomization pipe, the absorbing member, and the gasket are provided separately from the inlet pipe body, the members can respectively be replaced, thereby facilitating maintenance of the members.

In the above arrangement, it is preferable that the gasket is made of metal and formed separately from the ring body.

With this arrangement, because the gasket is made of metal, the gasket can be securely attached to the engine body by an adhesive sheet unlike a rubber gasket. Accordingly, positioning of the gasket is facilitated. Also, being made of metal, the gasket is formed hard to a certain degree. Such a gasket is more favorably handled as compared with a rubber gasket. Incidentally, examples of metal employable for the gasket include aluminum, stainless, and copper.

In the above arrangement, it is preferable that I/L is equal to or less than 0.6, where I indicates a length of the atomization pipe and L indicates a length of the inlet pipe intake passage.

With this arrangement, the length 1 of the atomization pipe is rationally equal to or less than 0.6 with respect to the length L of the inlet pipe intake passage. Because such an atomization pipe is sufficiently short, the atomization pipe is prevented from being broken by being bent together with the inlet pipe at the time of installation of the inlet pipe or at the time of work operation with the work machine in which the engine of the invention is installed.

DETAILED DESCRIPTION OF PREFERRED EMBODIMENT(S)

An embodiment of the invention will be described below with reference to the drawings.

Figure 1:
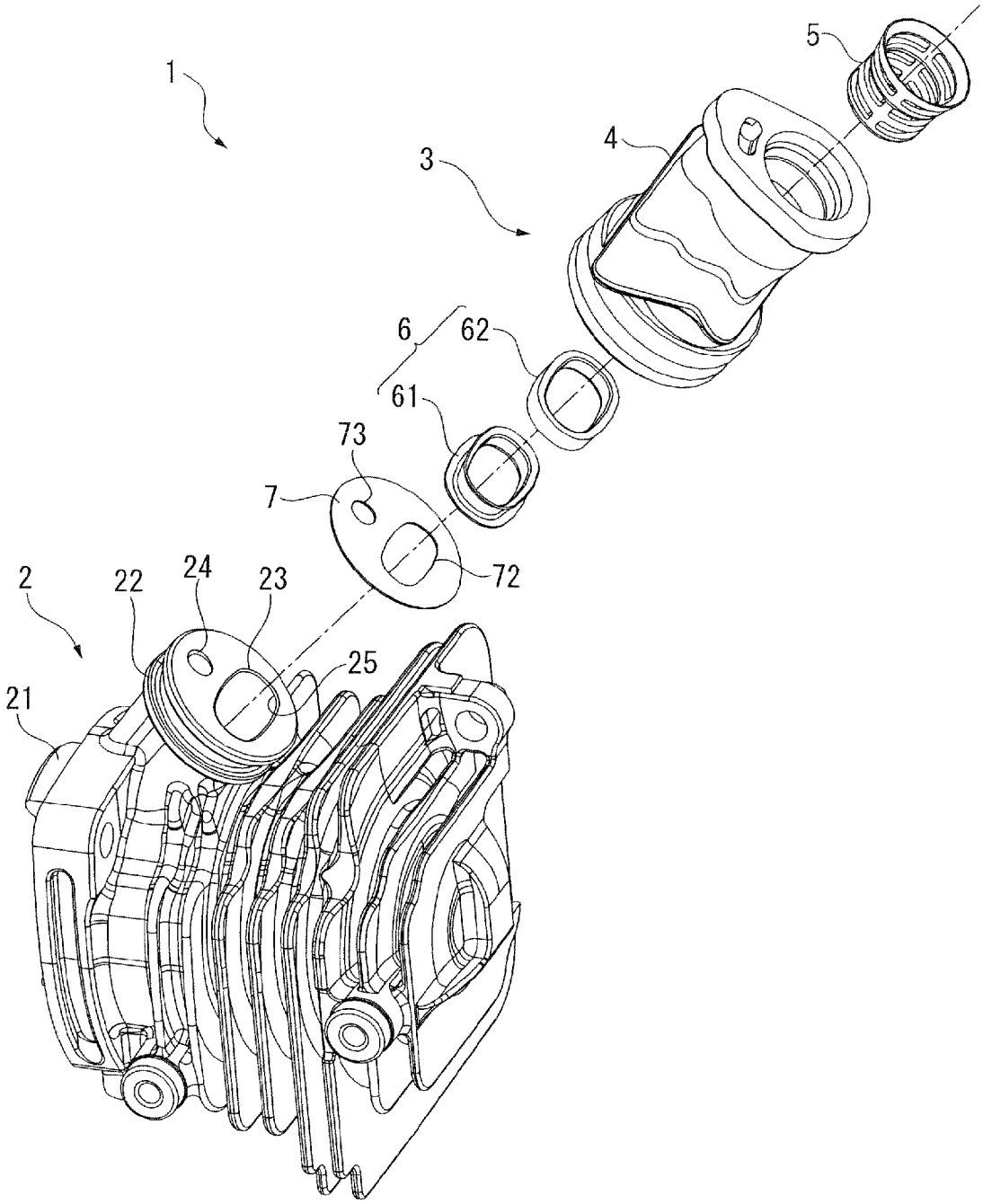
FIG. 1 is an exploded perspective view showing a primary portion of a two-cycle engine according to an embodiment of the invention.

FIG. 1 is an exploded perspective view showing a primary portion of a two-cycle engine 1 according to the embodiment.

The two-cycle engine 1 of the embodiment, which is a compact, approximately 18 cc engine, is suitably employed for a portable work machine such as a chain saw or a cut-off saw. The engine 1 includes: an engine body 2 (only a cylindrical portion thereof is shown in FIG. 1); a carburetor (not shown); and an inlet pipe 3 that connects the carburetor and the engine body 2.

The engine body 2 includes a crankcase (not shown), a cylinder 21, and a compact and lightweight flywheel, so that the weight of the engine body 2 is reduced. In the cylinder 21, an attaching portion 22 to which the inlet pipe 3 is attached and an engine body intake passage 23 and an engine body pulse-transmitting passage 24 which communicate with a crank chamber are formed. The engine body intake passage 23 includes an intake port 25, which is an opening on the attaching portion 22. The engine body pulse-transmitting passage 24 communicates with an inlet pipe pulse-transmitting passage 45 (see, FIG. 2) of the inlet pipe 3 to transmit a pressure pulsation in the crank chamber to the carburetor. The carburetor generates a mixture gas by sucking fuel from a fuel tank using the pressure pulsation in the pressure chamber and supplies the mixture gas to the crank chamber through the inlet pipe 3.

Figure 2:
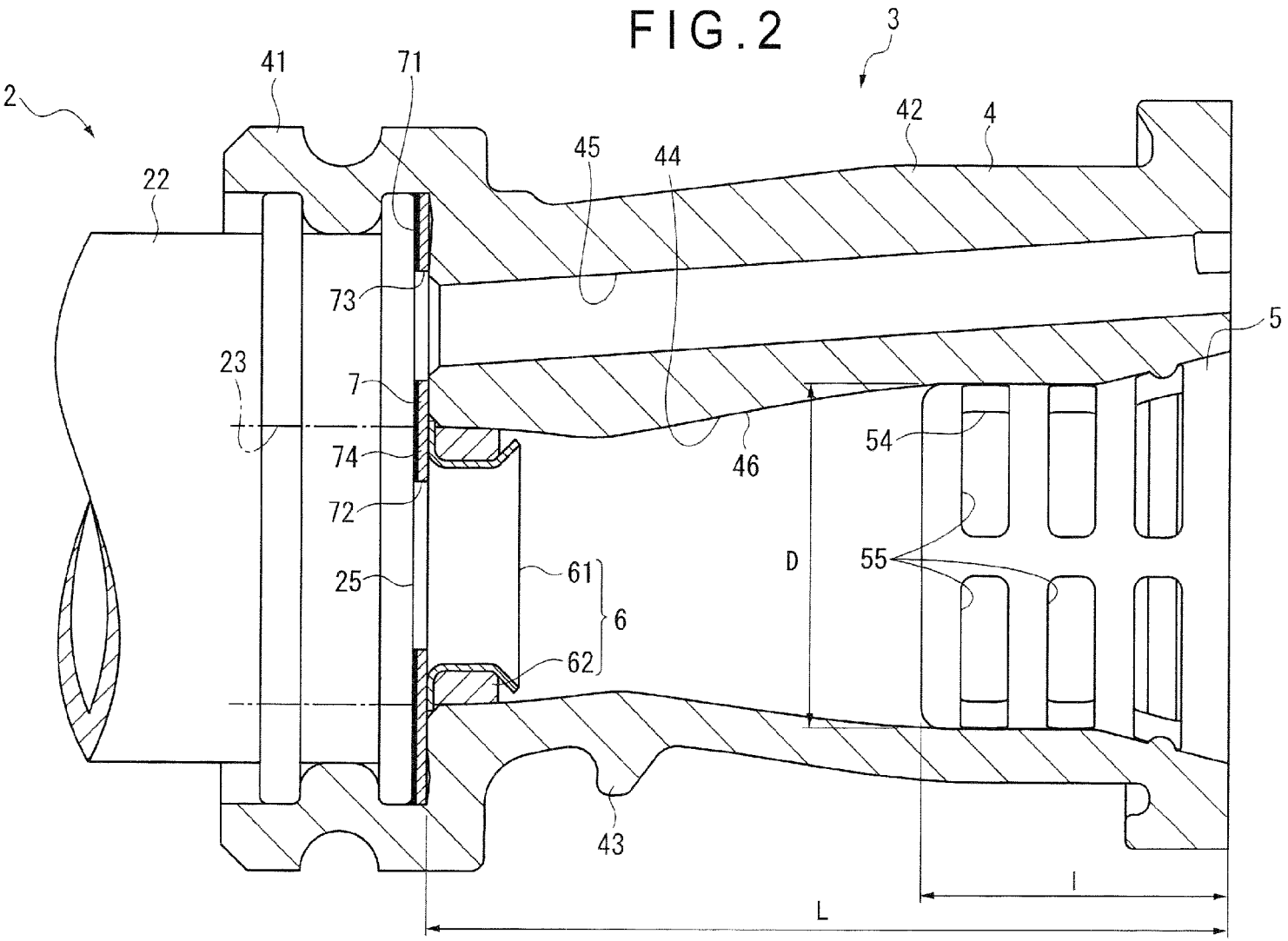
FIG. 2 is a lateral cross-sectional view of an inlet pipe according to the embodiment.

FIG. 2 is a lateral cross-sectional view of the inlet pipe 3.

As shown in FIGS. 1 and 2, the inlet pipe 3 includes an inlet pipe body 4, an atomization pipe 5, an absorbing ring 6, and a gasket 7. The atomization pipe 5, the absorbing ring 6, and the gasket 7 are installed in the inlet pipe body 4.

Figure 3:
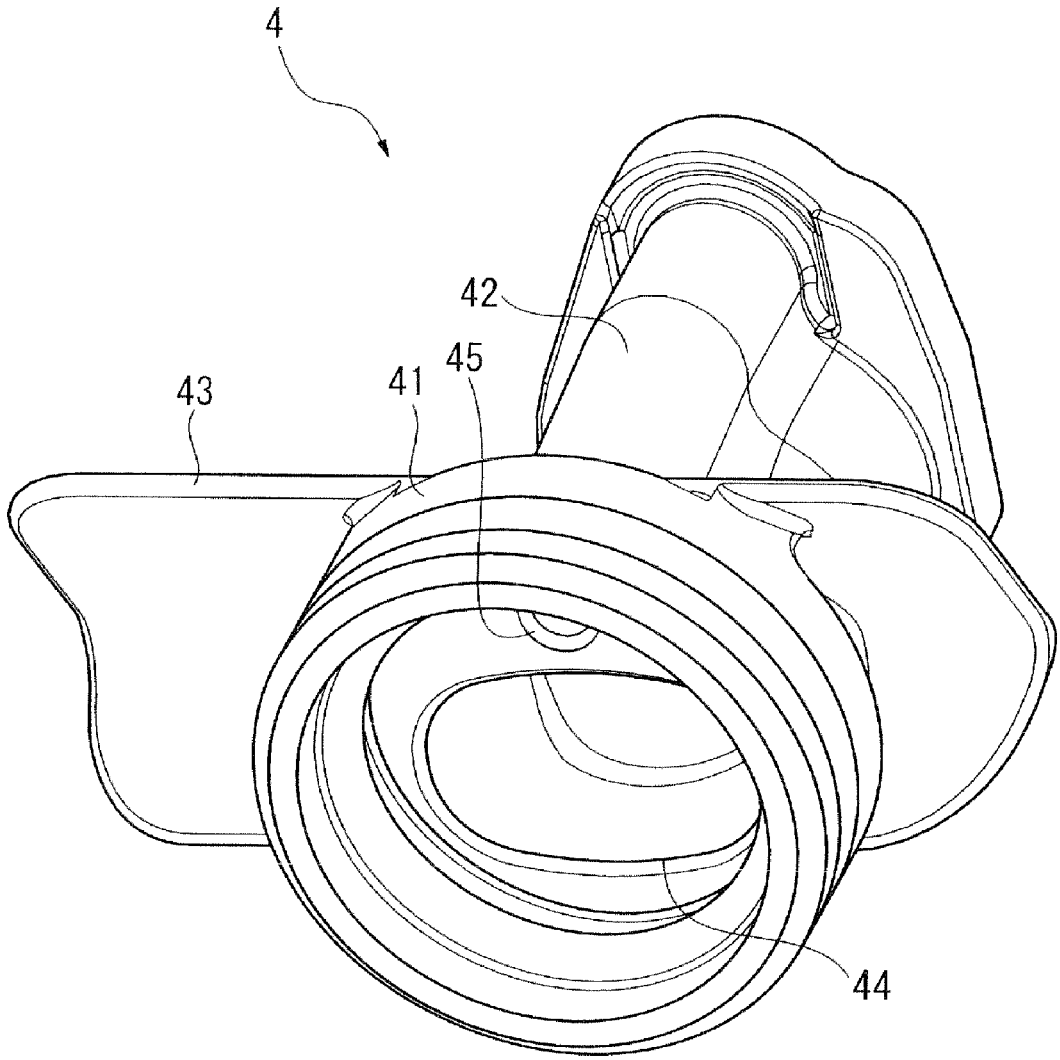
FIG. 3 is a perspective view of an inlet pipe body according to the embodiment.
Figure 4:
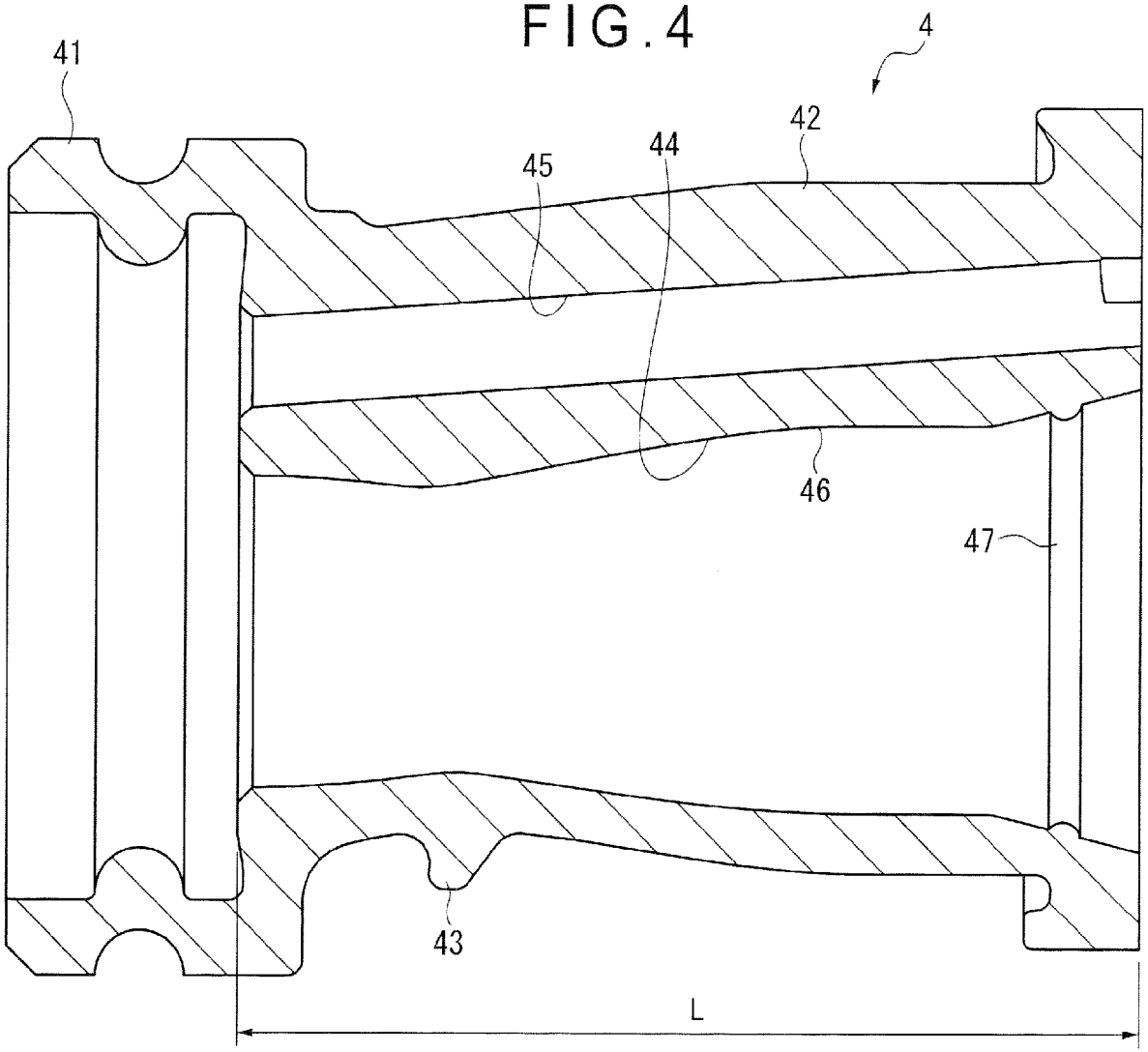
FIG. 4 is a lateral cross-sectional view of the inlet pipe body according to the embodiment.

FIG. 3 is a perspective view of the inlet pipe body 4, and FIG. 4 is a lateral cross-sectional view of the inlet pipe body 4.

The inlet pipe body 4 is made of rubber and is flexible. This inlet pipe body 4 includes: a fitting portion 41 fitted into the attaching portion 22, a passage portion 42 in which the inlet pipe intake passage 44 and the inlet pipe pulse-transmitting passage 45 are formed; and a brim 43 integrated with the passage portion 42 and extended laterally. A protrusion 47 is linearly formed on an inner wall of the inlet pipe intake passage 44 adjacent to the carburetor. The protrusion 47, to which the atomization pipe 5 is engaged, enables a stable installation of the atomization pipe 5. The length L of each of the inlet pipe intake passage 44 and the inlet pipe pulse-transmitting passage 45 is 30.3 mm in the embodiment.

The brim 43 closes an opening formed on a covering that covers the engine body 2 (i.e., the opening for attaching the inlet pipe body 4 to the attaching portion 22). In the embodiment, the brim 43 is, as noted above, integrated with the passage portion 42, thereby making dedicated members for closing the opening unnecessary and reducing the number of components.

Figure 5:
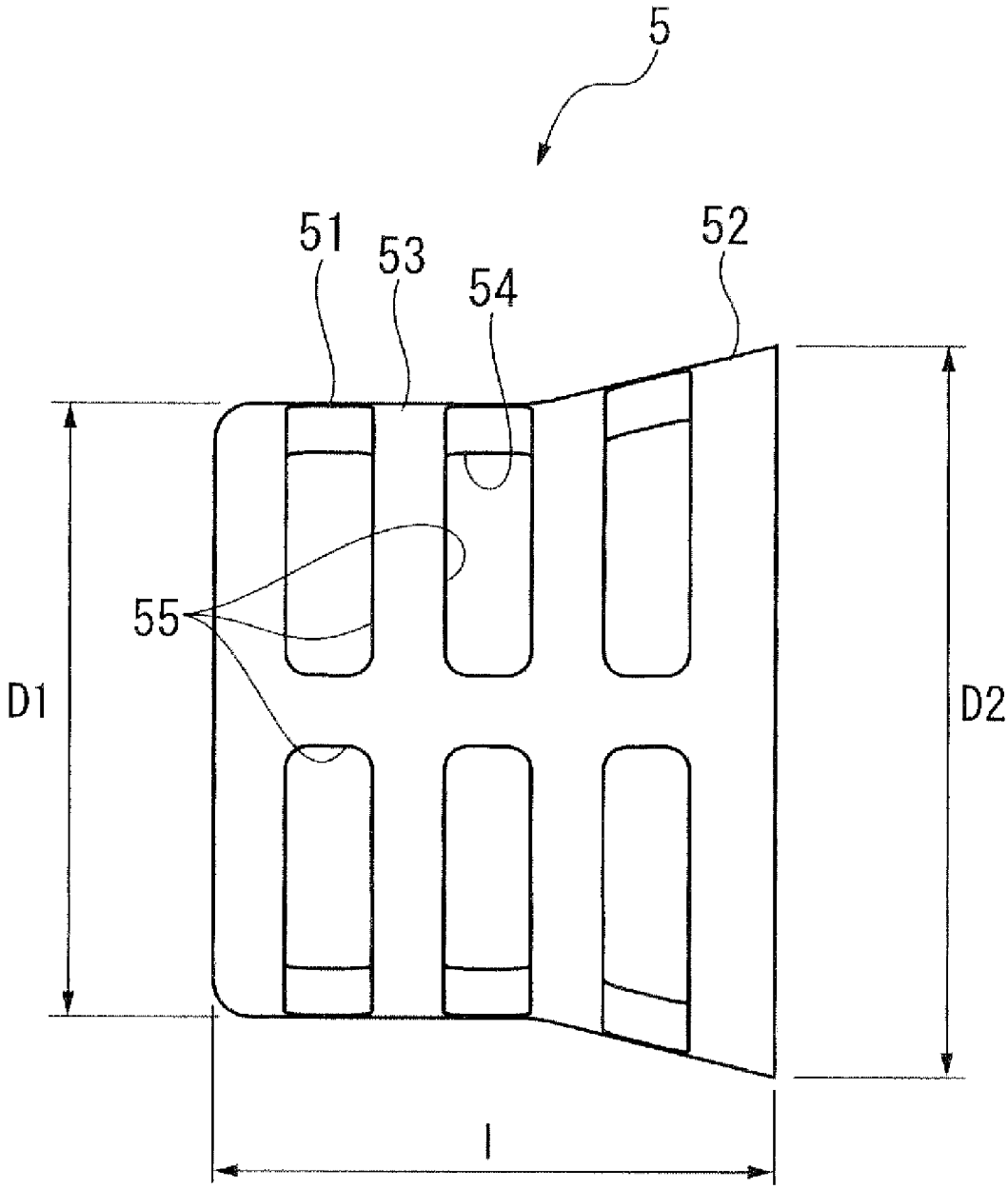
FIG. 5 is a lateral view of an atomization pipe according to the embodiment.

FIG. 5 is a lateral view of the atomization pipe 5.

The atomization pipe 5 is made of nylon 66 and is shaped in a bottomless basket, including a constant diameter portion 51 having a constant diameter and a widening portion 52 gradually widening toward a rear end (on the right side in FIG. 5) (see, FIG. 1) The length I of the atomization pipe 5 is 11.7 mm in the embodiment, so that the length ratio of the atomization pipe 5 to the pipe intake passage 44, i.e., I/L, is equal to 0.39. Here, a portable work machine in which the compact engine 1 is installed is made compact as a whole. Accordingly, the inlet pipe body 4 is usually bent when the inlet pipe body 4 is installed or when the work machine is in operation. Hence, if the atomization pipe 5 is long, the atomization pipe may be broken by being bent together with the inlet pipe body 4.

However, in the embodiment, the ratio I/L of the length of the atomization pipe 5 to the length L of the inlet pipe intake passage 44 is equal to or less than 0.6, which means that the atomization pipe 5 is formed sufficiently shorter than the inlet pipe body 4. Accordingly, the atomization pipe 5 is prevented from being broken by being bent together with the inlet pipe body 4. In addition, in the embodiment, being made of nylon 66, the atomization pipe 5 is flexible to be securely prevented from being broken. Incidentally, on account of being made of nylon 66, the atomization pipe 5 also has high durability against fuel.

In the embodiment, the minimum diameter D of the atomization pipe 5 is 13 mm, so that the ratio I/D of the minimum diameter D of the atomization pipe 5 and the length I is equal to 0.90. In the embodiment, since the ratio I/D of the minimum diameter D of the atomization pipe 5 and the length I is 1.3 or less, the atomization pipe 5 has appropriate flexibility. Accordingly, when the inlet pipe 3 is installed or the work machine is in operation, the atomization pipe 5 is permitted to be suitably deformed. Thus, the atomization pipe 5 is restrained from hampering deformation of the inlet pipe body 4. Therefore, the installation of the inlet pipe 3 and the working operation with the work machine can be conducted comfortably.

On an outer circumferential wall 53 of the atomization pipe 5, a plurality of through holes 55 each shaped in an elongated rectangle extending along a circumferential direction are formed. In the embodiment, fuel adhering on the inner wall 46 in the through hole 55 is confined by the through hole 55. In addition, when flowing toward the engine body 2, fuel adhering on an inner circumference 54 of the atomization pipe 5 enters the through hole 55 to be confined. Thus, a rapid increase in the amount of fuel flowing into the engine body is restrained. Moreover, by letting the excessive fuel in the mixture gas adhere on the inner circumference 54, the atomization pipe 5 also holds fuel surplus in the mixture gas.

Here, when the engine 1 has been driven for a long time, because the inlet pipe body 4 is warmed on account of heat influence from the engine body 2 side, the fuel adhering on the inner wall 46 is easily vaporized. When the engine 1 is started again, mixture gas tends to be dense as a result of a mixing of the vaporized fuel with new mixture gas. Thus, an ignition plug is likely to be fouled, thereby making it difficult to restart. However, in the embodiment, as set forth above, the excessive fuel in the mixture gas can be held by the atomization pipe 5, so that the mixture gas is prevented from being excessively dense, thereby facilitating the restart operation.

Figure 6:
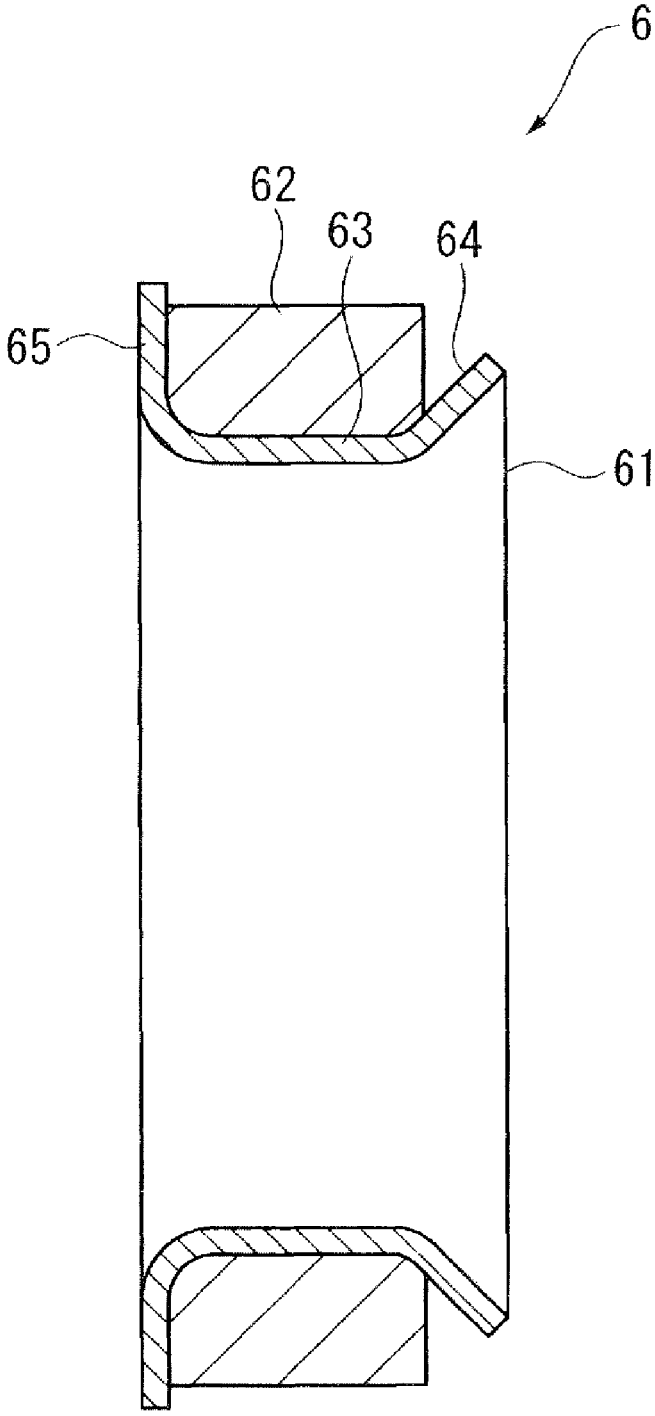
FIG. 6 is a cross-sectional view of an absorbing ring according to the embodiment.

FIG. 6 is a cross-sectional view of the absorbing pipe 6.

The absorbing pipe 6 includes a ring body 61 and a felt 62 (absorbing member) and is installed at a downstream side of the inlet pipe intake passage 44. The ring body 61, which is made of brass, includes a cylindrical portion 63, a widening portion 64 formed at a rear end side of the cylindrical portion 63 (in the right side of FIG. 6) and gradually widening toward the rear end, and an abutting portion 65 extending radially outward from the distal end side (in the left side of the FIG. 6), and is shaped in an oval ring. When the absorbing ring 6 is installed in the inlet pipe body 4, the abutting portion 65 abuts to the gasket 7.

The felt 62 is formed in an oval ring and attached to a circumference of the cylindrical portion 63 by an adhesive. When the absorbing ring 6 is installed in the inlet pipe body 4, an outer circumference of the felt 62 abuts to the inner wall 46 at the downstream side (see, FIG. 2). When the negative pressure in the engine body 2 is increased, the fuel adhering on the inner wall 46 flows toward the engine body 2. In the embodiment, since the felt 62 is provided to the downstream side of the inlet pipe intake passage 44, such fuel is absorbed by the felt 62. Accordingly, this arrangement also helps prevent the rapid increase of the amount of fuel flowing into the engine body 2.

As shown in FIGS. 1 and 2, the gasket 7 is made of aluminum and formed in a thin plate. The gasket 7 is attached to the attaching portion 22 by an adhesive sheet 71. Here, if the gasket 7 is made of rubber, the characteristic of the material does not allow the adhesive sheet 71 to be attached, so that the position of the gasket 7 is easily displaced at the time of installing the inlet pipe 3. Thus, positioning of the gasket 7 is made difficult. However, in the embodiment, since the gasket 7 is made of aluminum, the gasket 7 can be securely attached to the attaching portion 22 by the adhesive sheet 71, thereby facilitating the positioning. Also, being made of aluminum, the gasket 7 is formed hard to a certain degree. Such a gasket 7 is more favorably handled as compared with a rubber gasket.

An intake passage hole 72 and a pulse-transmitting passage hole 73 are formed on this gasket 7. The diameter of the intake passage hole 72 is smaller than the diameter of the inlet pipe intake passage 44 (engine body intake passage 23), and a periphery of the intake passage hole 72 forms a block 74 that protrudes from the inner wall 46 of the inlet pipe intake passage 44. In the embodiment, the block 74 can block flow toward the engine body 2 of the fuel, which has adhered on the inner wall 46 and has escaped absorption by the absorbing ring 6. Thus, the rapid increase of the amount of fuel flowing into the engine body 2 can be reliably prevented. In addition, the block 74 also prevents fuel (mixture gas) staying in the inlet pipe intake passage 44 from rapidly flowing into the engine body 2 when the posture of the portable work machine in which the engine 1 is installed changes.

Accordingly, in the embodiment, because the atomization pipe 5, the absorbing ring 6, and the gasket 7 can securely prevent fuel adhering on the inner wall 46 of the inlet pipe intake passage 44 and fuel (mixture gas) staying in the inlet pipe intake passage 44 from rapidly flowing into the engine body 2, the fluctuation of the number of revolutions of the engine 1 can be sufficiently restrained In addition, because the members 5 to 7 respectively are provided independently of the inlet pipe body 4 so as to be replaceable, maintenance of the members 5 to 7 can be easily conducted.

Modifications of Embodiment

Incidentally, the scope of the invention is not limited to the above-described embodiment, but includes modifications, improvements, and the like as long as an object of the invention is achieved.

For example, in the above embodiment, the absorbing ring 6 (ring body 61) and the gasket 7 are separately provided, but they may be integrally provided, thus achieving reduction of the number of components.

In the above embodiment, the atomization pipe 5 is made of nylon 66. However, the atomization pipe 5 does not need to be made of nylon 66 but may be made of any suitable resin.

The Japanese application Number JP2007-210765 upon which this patent application is based is hereby incorporated by reference.

What is claimed is:

1. A two-cycle engine comprising:

a carburetor, an engine body, and an inlet pipe in which an inlet pipe intake passage that communicates the carburetor and the engine body is formed, wherein the inlet pipe includes an inlet pipe body in which the inlet pipe intake passage is formed, an atomization pipe fitted with the inlet pipe intake passage, an absorbing ring fitted with the inlet pipe intake passage, and a gasket interposed between the engine body and the inlet pipe body, the atomization pipe is shaped in a bottomless basket and having a plurality of through holes formed on an outer circumferential wall thereof, the absorbing ring includes a ring-shaped ring body and an absorbing member provided to an outer circumference of the ring body and abutting to an inner wall of the inlet pipe intake passage, and the gasket is provided with an intake passage hole whose opening area is smaller than an opening area of the inlet pipe intake passage.

2. The two-cycle engine according to claim 1, wherein the gasket is made of metal and formed separately from the ring body.

3. The two-cycle engine according to claim 1 wherein

I/L is equal to or less than 0.6, where I indicates a length of the atomization pipe and L indicates a length of the inlet pipe intake passage.

4. The two-cycle engine according to claim 2, wherein

I/L is equal to or less than 0.6, where I indicates a length of the atomization pipe and L indicates a length of the inlet pipe intake passage.

* * * * *